US008529297B2

(12) United States Patent
Chang

(10) Patent No.: US 8,529,297 B2
(45) Date of Patent: Sep. 10, 2013

(54) NETWORK CONNECTOR STRUCTURE

(76) Inventor: Nai-Chien Chang, New Taipei (TW)

( * ) Notice: Subject to any disclaimer, the term of this patent is extended or adjusted under 35 U.S.C. 154(b) by 0 days.

(21) Appl. No.: 13/490,620

(22) Filed: Jun. 7, 2012

(65) Prior Publication Data

US 2013/0084720 A1 Apr. 4, 2013

(30) Foreign Application Priority Data

Sep. 30, 2011 (TW) ..... 100218321 U

(51) Int. Cl.
*H01R 13/66* (2006.01)

(52) U.S. Cl.
USPC ..... 439/620.09; 439/676; 439/620.24; 439/620.21

(58) Field of Classification Search
USPC ..... 439/620.09–620.25, 76.1, 676
See application file for complete search history.

(56) References Cited

U.S. PATENT DOCUMENTS 6,497,588 B1 * 12/2002 Scharf et al. ..... 439/607.38
8,152,564 B2 * 4/2012 Chang ..... 439/607.01
8,182,283 B2 * 5/2012 Chang ..... 439/541.5
8,460,030 B2 * 6/2013 Chang ..... 439/541.5
2002/0086584 A1 * 7/2002 Liu ..... 439/620
2007/0015416 A1 * 1/2007 Gutierrez et al. ..... 439/676
2012/0040559 A1 * 2/2012 Chang ..... 439/607.01
2013/0051737 A1 * 2/2013 Chang ..... 385/92
2013/0084720 A1 * 4/2013 Chang ..... 439/83
2013/0141875 A1 * 6/2013 Chang ..... 361/733
2013/0141876 A1 * 6/2013 Chang ..... 361/733

* cited by examiner

*Primary Examiner* — James Harvey
(74) *Attorney, Agent, or Firm* — Chun-Ming Shih; HDLS IPR Services

(57) ABSTRACT

A network connector structure includes an insulating body having a port inwardly formed at a front-end surface of the insulating body, a containing space formed in the insulating body insulating body, and a first circuit board and a second circuit board parallely installed and electrically coupled to each other. A plurality of connecting terminals and a plurality of filter elements are electrically coupled to the first circuit board, and at least one network integrated circuit and a plurality of soldered terminals are electrically coupled to the second circuit board. The network connector is electrically coupled to an external transmission line through the plurality of connecting terminals, and electrically coupled to a motherboard of an external electronic device through the plurality of soldered terminals, so that the network integrated circuit inside the network connector provide network signal encoding/decoding functions directly.

10 Claims, 8 Drawing Sheets

NETWORK CONNECTOR STRUCTURE

FIELD OF THE INVENTION

The present invention relates to connectors, in particular to a network connector.

BACKGROUND OF THE INVENTION

As the electronic industry blooms, various electronic devices are continuously developed and introduced in our life. In order to input a control instruction to control the electronic devices or transmit data between the electronic devices, most electronic devices are equipped with a plurality of connectors installed on a motherboard. Signals transmitted and received by various connectors are encoded/decoded by at least one integrated circuit (IC) installed on a motherboard. For example, a RJ-45 network connector is electrically coupled to a motherboard of an electronic device, and an external network circuit is connected for receiving external network signals. After the network connector receives a network signal, the network signal is transmitted to the motherboard, and after a network integrated circuit installed on the motherboard is used for decoding the network signal, a corresponding component such as a central processing unit (CPU) installed on the motherboard is used for operations. On the other hand, if the motherboard needs to transmit a network signal to the outside through the network connector, the network signal is transmitted to the network integrated circuit and encoded first, and then the encoded network signal is transmitted to the outside through the network connector.

However, the installed connectors occupy much space on the motherboard, so that the installation of one or more network integrated circuits on the motherboard will waste much precious installation space on the motherboard. In a process of developing electronic devices, miniaturization is a mainstream design factor of the electronic devices, and it is an important subject for related designers and manufacturers to save spaces on the motherboard.

Obviously, a novel connector capable of encoding/decoding network signals without installing any additional network integrated circuits required to overcome the problems of the prior art.

SUMMARY OF THE INVENTION

Therefore, it is a primary objective of the present invention to provide an improved network connector structure with the functions of encoding and decoding network signals by a network connector without requiring the installation of any additional network integrated circuit on a motherboard of an electronic device.

To achieve the aforementioned objective, the present invention provides an insulating body, a port inwardly formed at a front-end side of the insulating body, and a first circuit board and a second circuit board installed inside the insulating body, wherein the first circuit board and the second circuit board are parallely installed and electrically coupled to each other. The first circuit board is electrically coupled to a plurality of connecting terminals and a plurality of filter elements, and the second circuit board is electrically coupled to at least one network integrated circuit and a plurality of soldered terminals. When the network connector receives a network signal, the network signal is sequentially processed by a filter element and a network integrated circuit installed inside the network connector and then transmitted to the outside Compared with the prior art, the present invention has the following effects. The network connector has a built-in network integrated circuit, so that the motherboard no longer requires any installation of additional network integrated circuits to encode/decode the network signal. In other words, it is not necessary to reserve any wiring space on the motherboard for installing the network integrated circuit, so as to save precious installation space on the motherboard. Further, the filter element and the network integrated circuit are integrated into a single network connector, so that the signal compatibility can be tested and calibrated during the manufacture, and the stability of the network connector can be enhanced.

DESCRIPTION OF THE PREFERRED EMBODIMENTS

The technical contents of the present invention will become apparent with the detailed description of preferred embodiments accompanied with the illustration of related drawings as follows. It is noteworthy that the drawings are provided for the purpose of illustrating the present invention only, but not intended for limiting the scope of the invention.

Figure 1:
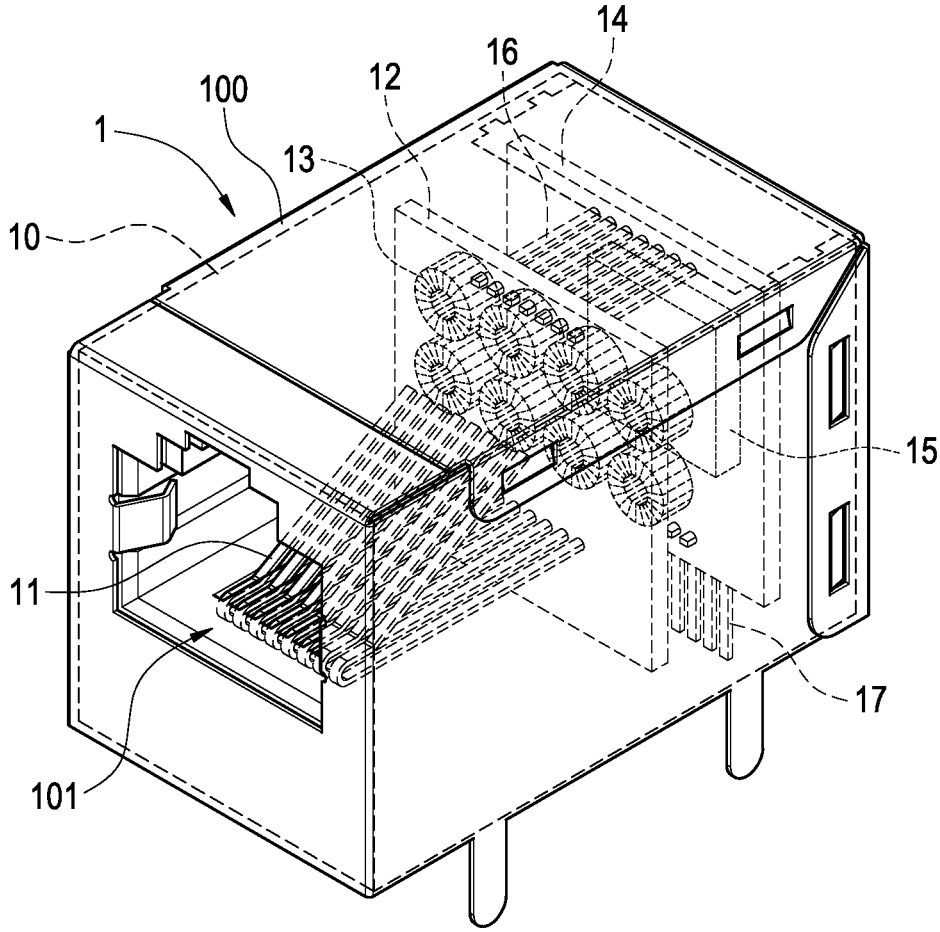
FIG. 1 is a perspective view of a first preferred embodiment of the present invention.
Figure 2:
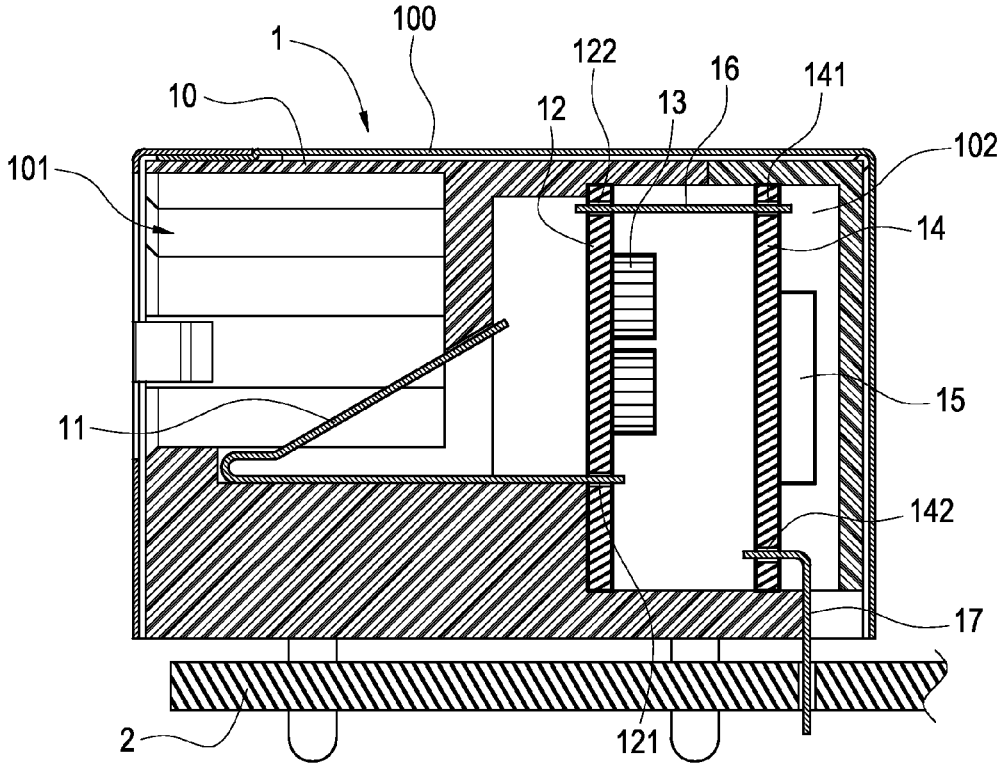
FIG. 2 is a cross-sectional view of the first preferred embodiment of the present invention.

With reference to FIGS. 1 and 2 for a perspective view and a cross-sectional view of a network connector in accordance with the first preferred embodiment of the present invention respectively, the network connector 1 comprises an insulating body 10, and a port 101 inwardly formed at a front-end side of the insulating body 10 and having a containing space 102 formed in the insulating body 10.

The network connector 1 further includes a first circuit board 12 and a second circuit board 14 installed in the containing space 102 of the insulating body 10. In the figures, the first circuit board 12 and the second circuit board 14 are installed parallel to each other, and the first circuit board 12 is electrically coupled to the second circuit board 14. The first circuit board 12 includes a plurality of connecting terminals 11 and a plurality of filter elements 13, and the plurality of connecting terminals 11 are extendibly installed in the port 101 of the second circuit board 14. When an external network circuit (not shown in the label) is plugged into the port 101, the terminals in the network line are respectively and electrically coupled to the plurality of connecting terminals 11 of the port 101 and provided for transmitting network signals through the network connector 1. More specifically, the network connector 1 of the present invention is a connector with the RJ-45 specification, and the port 101 has a shape corresponding to the shape of the RJ-45 connector, and the quantity of connecting terminals 11 includes but not limited to eight.

In this preferred embodiment, the filter element 13 is mainly used for filtering the signal transmitted by the network connector 1, and the filter element 13 can be comprised of at least one resistor, capacitor, transformer or any combination of the above. In the figure, the filter element 13 is a transformer, but the invention is not limited to transformers only.

The second circuit board 14 includes at least one network integrated circuit (IC) 15 and a plurality of soldered terminals 17, and an end of the plurality of soldered terminals 17 is electrically coupled to the second circuit board 14, and the other end of the plurality of soldered terminals 17 is extended downwardly and protruded out from the bottom of the network connector 1. Therefore, the network connector 1 is electrically coupled to a motherboard 2 of an external electronic device through the plurality of soldered terminals 17 and provided for transmitting network signals with the motherboard 2.

The network signal transmitted by the network connector 1 (regardless of being transmitted from the motherboard 2 or from the external network circuit) is encoded/decoded by the network integrated circuit 15 of the second circuit board 14. Therefore, the motherboard 2 no longer requires any additional installation of another network integrated circuit, so that the space of the motherboard 2 can be saved significantly to achieve the effect of miniaturizing the electronic device. Further, the filter element 13 and the network integrated circuit 15 are integrated into a single network connector 1, and the signal compatibility can be tested and calibrated during the manufacturing process to enhance the stability of the network connector 1 and lower the manufacturing cost of the electronic device effectively.

In this preferred embodiment, the first circuit board 12 and the second circuit board 14 are installed parallel to each other, and the first circuit board 12 and the second circuit board 14 are perpendicular to the motherboard 2 when the network connector 1 is electrically coupled to the motherboard 2.

Figure 3:
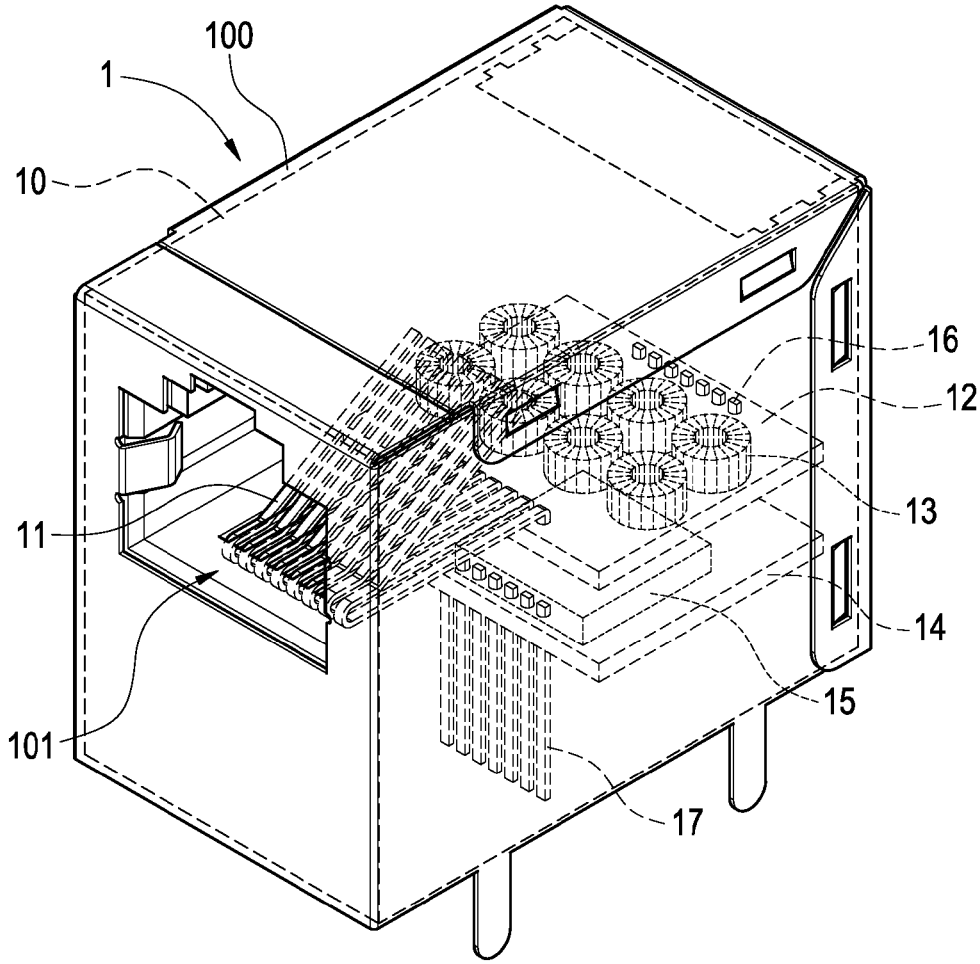
FIG. 3 is a perspective view of a second preferred embodiment of the present invention.
Figure 4:
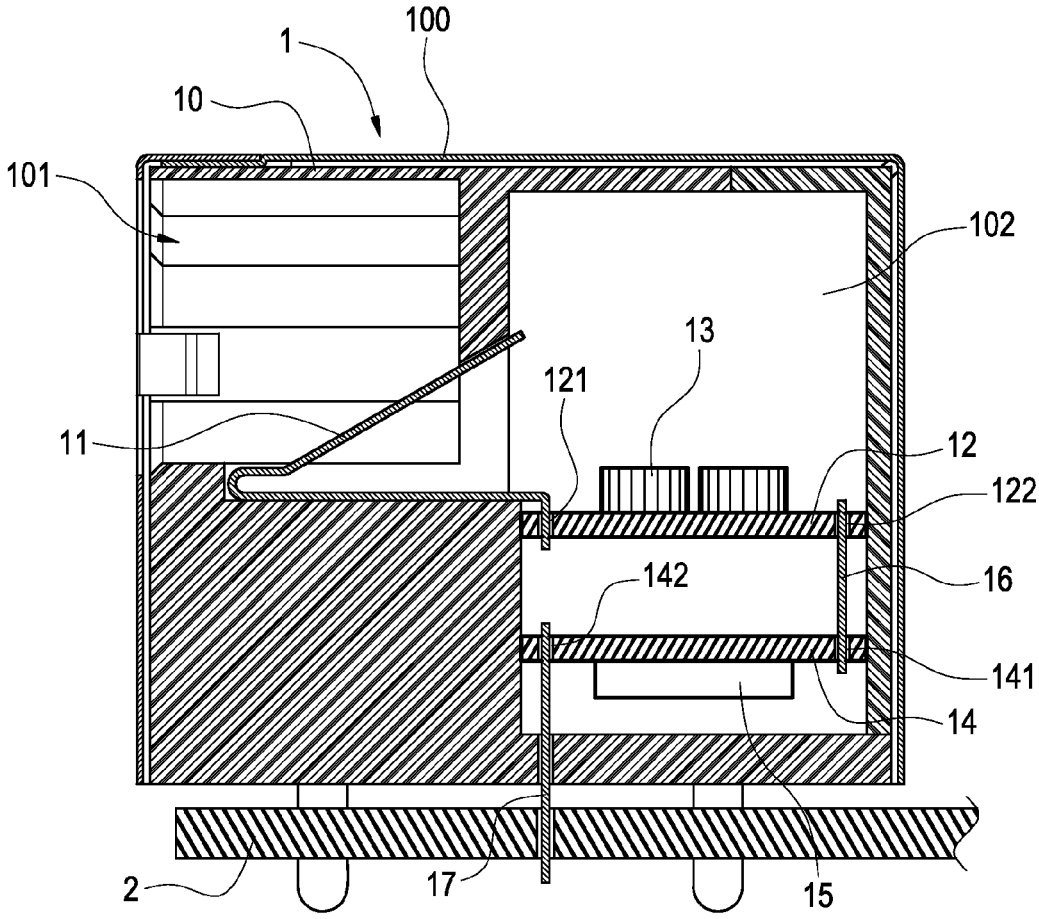
FIG. 4 is a cross-sectional view of the second preferred embodiment of the present invention.

With reference to FIGS. 3 and 4 for a perspective view and a cross-sectional view of a network connector in accordance with the second preferred embodiment of the present invention respectively, the internal configuration of the network connector 1 is compatible with that as shown in FIGS. 1 and 2, and the only difference resides on that when the network connector 1 is electrically coupled to the motherboard 2, the first circuit board 12 and the second circuit board 14 are parallel to the motherboard 2.

The first circuit board 12 further includes a plurality of front-end contacts 121 and a plurality of back-end contacts 122 disposed at positions away from the plurality of front-end contacts 121; and the second circuit board 14 also includes a plurality of front-end contacts 142, and a plurality of back-end contacts 141 disposed at positions away from the plurality of front-end contacts 142, and the plurality of connecting terminals 11 are electrically coupled to the plurality of front-end contacts 121 of the first circuit board 12, and electrically coupled to the plurality of filter elements 13 of the first circuit board 12. An end of the plurality of soldered terminals 17 is electrically coupled to the plurality of front-end contacts 142 of the second circuit board 14 and electrically coupled to the network integrated circuit 15 of the second circuit board 14.

The network connector 1 further includes a plurality of signal transfer terminals 16 respectively and electrically coupled to the plurality of back-end contacts 122 of the first circuit board 12 and the plurality of back-end contacts 141 of the second circuit board 14, and the first circuit board 12 and the second circuit board 14 are electrically coupled to each other through the plurality of signal transfer terminals 16 to transmit network signals.

It is noteworthy that the network connector 1 further comprises a metal casing 100 for covering external surfaces of the insulating body 10 to provide a metal shielding function for the network connector.

Figure 5:
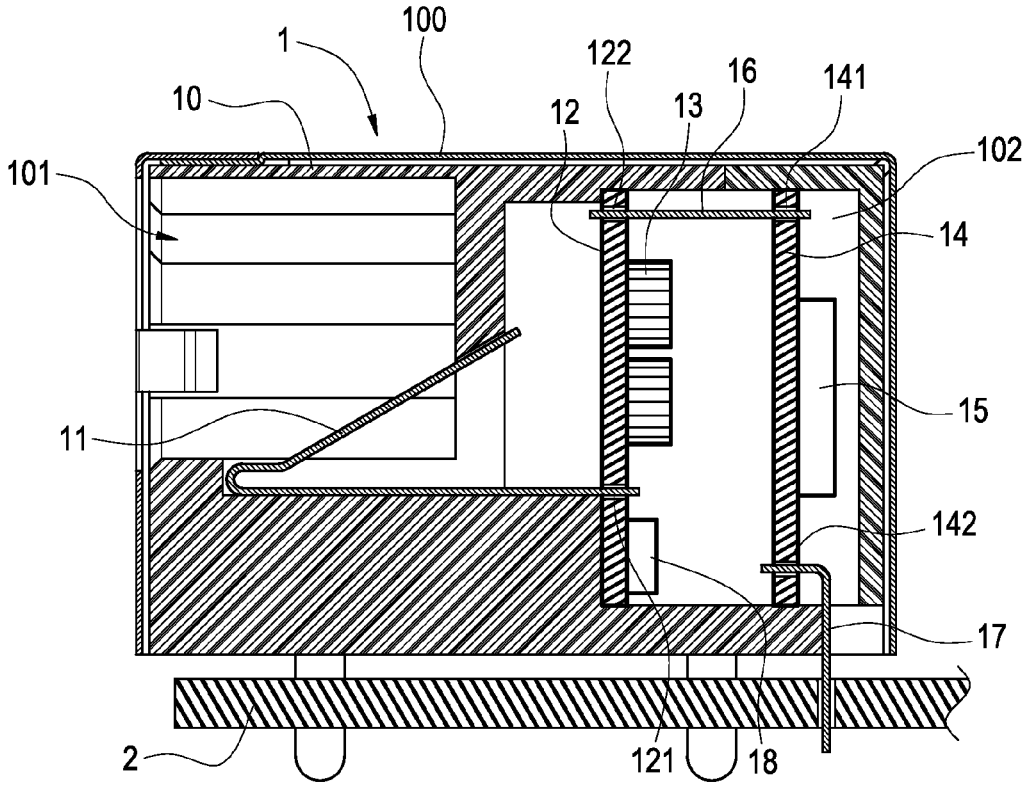
FIG. 5 is another cross-sectional view of the first preferred embodiment of the present invention.
Figure 6:
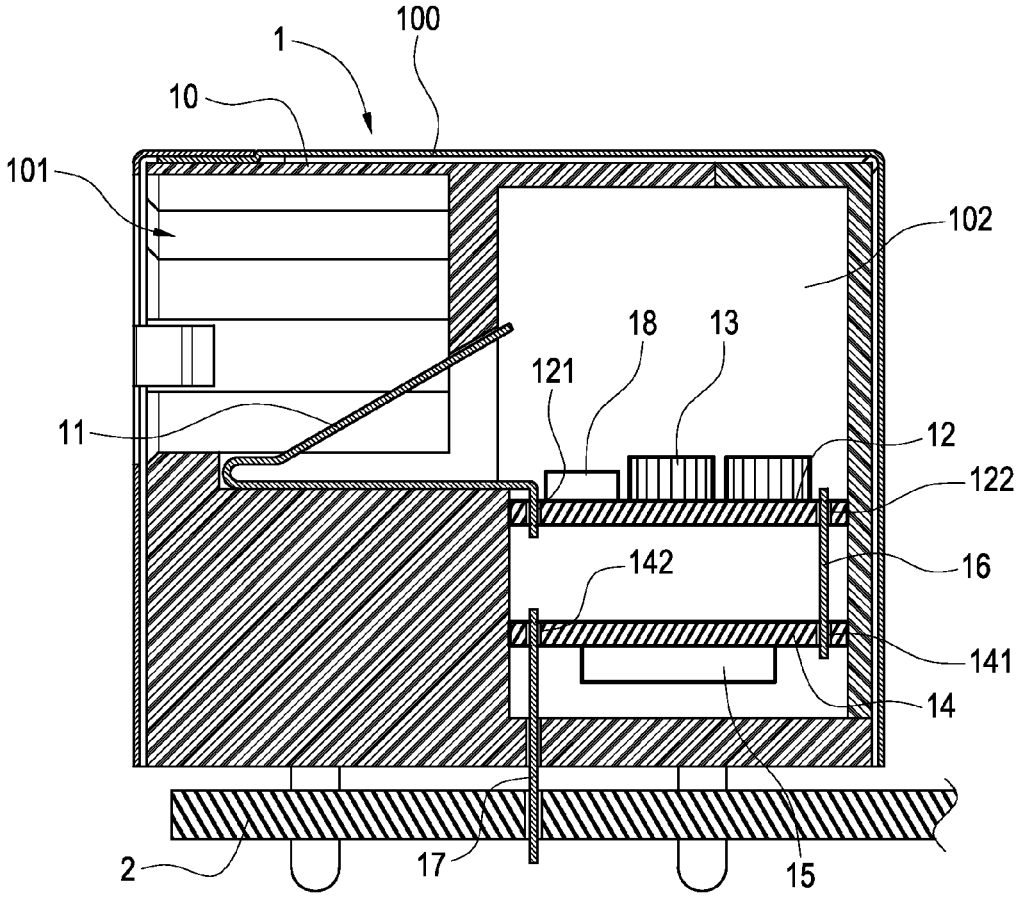
FIG. 6 is another cross-sectional view of the second preferred embodiment of the present invention.

With reference to FIGS. 5 and 6 for other cross-sectional views of a network connector in accordance with the first and second preferred embodiments of the present invention respectively, the network connector 1 further comprises at least one protection device 18 installed therein and electrically coupled to the first circuit board 12. The protection device 18 can be a surge protection component including but not limited to a transformer, a transient voltage suppressor (TVS), a gas discharge tube (GDT), a high-voltage capacitor, an electromagnetic interference (EMI) protection element or any combination of the above. The protection device 18 is provided for protecting the network connector 1 from being damaged by a high-voltage surge which is produced during a thunder and transmitted to the network connector 1 through the network line.

Figure 7:
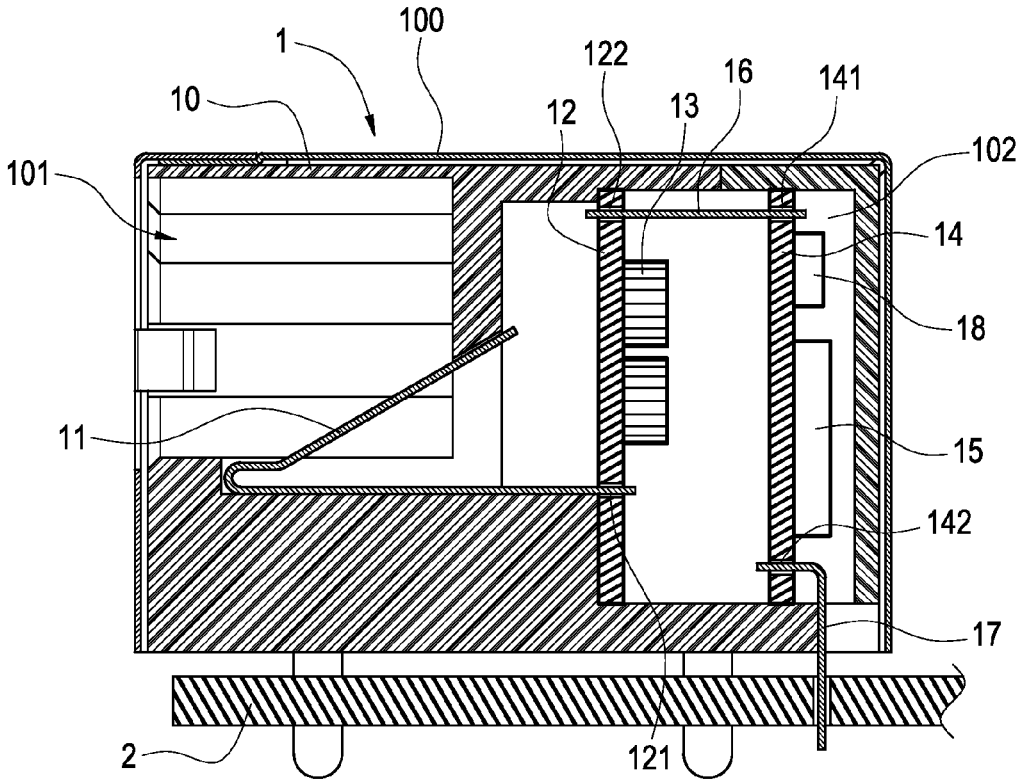
FIG. 7 is a further cross-sectional view of the first preferred embodiment of the present invention.
Figure 8:
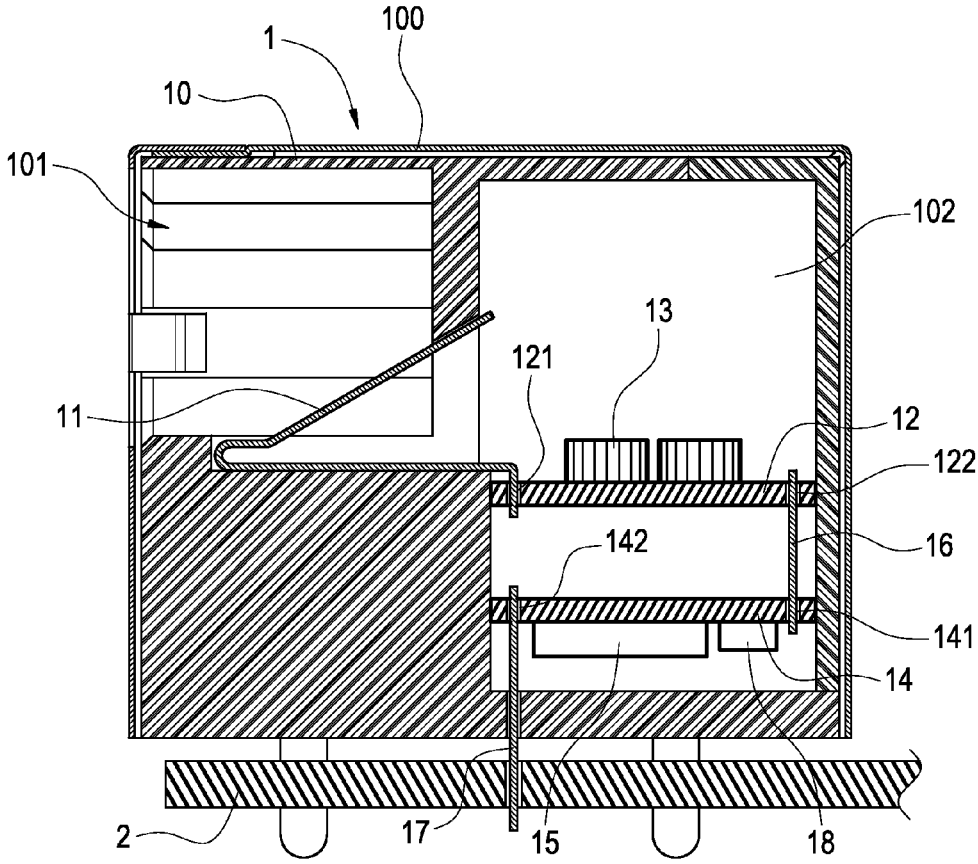
FIG. 8 is a further cross-sectional view of the second preferred embodiment of the present invention.

With reference to FIGS. 7 and 8 for further cross-sectional views of a network connector in accordance with the first and second preferred embodiments of the present invention respectively, the protection device 18 is electrically coupled to the first circuit board 12 and/or the second circuit board 14 depending on a manufacturer's settings of the network connector 1.

It is noteworthy that the production of a high-voltage surge mainly occurs at a thunder, and the high-voltage surge is transmitted from the network to the network connector 1. When an external signal is received, the signal is passed sequentially through the plurality of connecting terminals 11, the plurality of filter elements 13, the network integrated circuit 15, the plurality of soldered terminals 17, and finally transmitted to the motherboard 2. To protect the network integrated circuit 15 from being burned or damaged by the high-voltage surge occurred at a thunder, so that the protection device 18 must be installed in front of the network integrated circuit 15.

In the present invention, the filter element 13, the network integrated circuit 15 and the protection device 18 are integrated into a single network connector 1, so that the installation space on the motherboard 2 can be saved significantly, and the manufacturing cost can be lowered effectively. As to manufacturers, the network connector 1 of the present invention is indeed a great boon.

While the invention has been described by means of specific embodiments, numerous modifications and variations could be made thereto by those skilled in the art without departing from the scope and spirit of the invention set forth in the claims.

What is claimed is:

1. A network connector structure, electrically coupled to a motherboard of an external electronic device, comprising:

an insulating body, having a port inwardly formed at a front-end surface of the insulating body and a containing space formed in the insulating body;

a first circuit board, installed in the containing space, and having a plurality of connecting terminals and a plurality of filter elements electrically coupled to the first circuit board, and the plurality of connecting terminals being extendibly installed in the port; and a second circuit board, installed in the containing space and parallel to the first circuit board, and electrically coupled to the first circuit board, and having at least one network integrated circuit and a plurality of soldered terminals installed on the second circuit board, and the other end of the plurality of soldered terminals being extended downwardly and protruded out from the bottom of the network connector;

such that the network connector is electrically coupled to an external network circuit through the plurality of connecting terminals, and the network connector is electrically coupled to a motherboard of the external electronic device through the plurality of soldered terminals.

2. The network connector structure of claim 1, wherein the first circuit board and the second circuit board are perpendicular to the motherboard when the network connector is electrically coupled to the motherboard.

3. The network connector structure of claim 1, wherein the first circuit board and the second circuit board are parallel to the motherboard when the network connector is electrically coupled to the motherboard.

4. The network connector structure of claim 1, wherein the first circuit board comprises a plurality of front-end contacts formed thereon and a plurality of back-end contacts disposed at positions away from the plurality of front-end contacts, and the second circuit board comprises a plurality of front-end contacts and a plurality of back-end contacts disposed at positions away from the plurality of front-end contacts, and the plurality of connecting terminals are electrically coupled to the plurality of front-end contacts of the first circuit board respectively, and the plurality of soldered terminals are electrically coupled to the plurality of front-end contacts of the second circuit board respectively, and the network connector further comprises a plurality of signal transfer terminals respectively and electrically coupled to the plurality of back-end contacts of the first circuit board and the plurality of back-end contacts of the second circuit board.

5. The network connector structure of claim 1, wherein the plurality of filter elements include a resistor, a high-voltage capacitor, a transformer or any combination thereof.

6. The network connector structure of claim 1, further comprising a metal casing for covering the insulating body.

7. The network connector structure of claim 1, wherein the first circuit board further comprises at least one protection device installed thereon.

8. The network connector structure of claim 7, wherein the at least one protection device is a transformer, a transient voltage suppressor (TVS), a gas discharge tube (GDT), a high-voltage capacitor, an electromagnetic interference (EMI) protection element or any combination thereof.

9. The network connector structure of claim 1, wherein the second circuit board further comprises at least one protection device installed thereon.

10. The network connector structure of claim 9, wherein the at least one protection device is a transformer, a transient voltage suppressor (TVS), a gas discharge tube (GDT), a high-voltage capacitor, an electromagnetic interference (EMI) protection element or any combination thereof.

* * * * *